United States Patent [19]

Igarashi

[11] Patent Number: 4,724,408

[45] Date of Patent: Feb. 9, 1988

[54] WAVEGUIDE FILTER

[75] Inventor: Sadao Igarashi, Soma, Japan

[73] Assignee: Alps Electric Co., Ltd., Japan

[21] Appl. No.: 900,496

[22] Filed: Aug. 26, 1986

[30] Foreign Application Priority Data

Aug. 27, 1985 [JP] Japan ..... 60-187958

[51] Int. Cl.[4] ..... H01P 1/208

[52] U.S. Cl. ..... 333/212; 333/208

[58] Field of Search ..... 333/208–212, 333/202, 239, 248

[56] References Cited

U.S. PATENT DOCUMENTS

| | | | |
|---|---|---|---|
| 3,137,828 | 6/1964 | Gerig et al. | 333/212 |
| 3,544,927 | 12/1970 | Elder et al. | 333/208 X |
| 3,697,898 | 10/1972 | Blachier et al. | 333/21 A |
| 4,260,967 | 4/1981 | Flieger | 333/208 |
| 4,268,804 | 5/1981 | Spinner et al. | 333/125 |
| 4,320,367 | 3/1982 | Boujet | 333/209 |
| 4,396,896 | 8/1983 | Williams | 333/212 |

FOREIGN PATENT DOCUMENTS

| | | | |
|---|---|---|---|
| 163823 | 10/1953 | Australia | 333/212 |
| 731498 | 6/1955 | United Kingdom | 333/212 |

OTHER PUBLICATIONS

Tahan—"Microwave Filter Design Techniques", *The Microwave Journal,* Mar. 1962; pp. 111–116.

*Primary Examiner*—Marvin L. Nussbaum
*Attorney, Agent, or Firm*—Guy W. Shoup

[57] ABSTRACT

A waveguide filter comprises waveguides with length corresponding to the center frequency of a band pass filter, and shunt plates. Each shunt inductor plate has sufficient size to cover an opening of the wave guide and includes an induction window smaller than the opening, and each opening is opposed to each induction window. The waveguides and the shunt inductor plates are alternately arranged in close contact state, and the center frequency of the filter scarcely deviates.

2 Claims, 12 Drawing Figures

WAVEGUIDE FILTER

BACKGROUND OF THE INVENTION

1. Field of the Invention

The present invention relates to a waveguide filter used in a communication apparatus of microwave and millimeter wave band.

2. Description of the Prior Art

In satellite transmission, since a ground station and a satellite are separated by a distance as long as 35,900 km (in the case of a stationary satellite), radio wave inputted to a receiver is very weak. Consequently, a filter to treat such weak radio wave must be one with small passing transmission loss. An example of a filter with small loss adopted frequently is a wavequide filter having high selectivity Q. Also in the transmission side, since high power is transmitted, energy lost by the passing transmission is converted into heat energy thereby a transmitting apparatus may be heated in similar manner to the receiving side. Consequently, a waveguide filter with small passing transmission loss is frequently adopted not only in the receiving side but also in the transmission side.

In usual, a waveguide filter in basic structure as shown in FIG. 3 comprises a waveguide with square cross-section, and shunt inductor plates installed to the waveguide so as to divide it into a plurality of partitions each constituting a resonator. The waveguide filter is called a shunt inductor type waveguide filter.

In FIG. 3, numeral 21 designates a waveguide, numerals 22~29 shunt inductor plates to form induction windows (hereinafter referred to as "inductor plates"), and numerals 30~32 waveguide resonators. The inductor plates 22, 26, the inductor plates 23, 27, and part of the waveguide 21 enclosed by the inductor plates 22, 23, 26, 27 constitute one waveguide resonator 30, and the inductor plates 23, 24, 27, 28 and part of the waveguide 21 enclosed by these inductor plates constitute other waveguide resonator 31, and further the inductor plates 24, 25, 28, 29 and part of the waveguide 21 enclosed by these inductor plates constitute other waveguide resonator 32, thus these waveguide resonators 30~32 constitute a waveguide filter of three stages. The center frequency of resonance and the pass band width of the waveguide filter are determined by dimensions in width, height, length of the tube of the waveguide 21 and in width of each of the inductor plates 22~29 (size of the induction window).

Specific constitution of a waveguide filter in the prior art will be described referring to FIG. 4 and FIG. 5. In FIG. 4 and FIG. 5, parts similar to those in FIG. 3 are designated by the same reference numerals and the overlapped description shall be omitted.

In FIG. 4 and FIG. 5, numerals 33~40 designate grooves formed on the waveguide 21 for insertion of the induction plates 22~29, numerals 41, 42 flanges, and numerals 43~50 soldering by which the inductor plates 22~29 inserted in the grooves 33~40 are fixed to the waveguide 21. The grooves 33~40 of prescribed depth are formed at prescribed intervals on the waveguide 21, and the inductor plates 22~29 each being larger than height of the waveguide 21 or depth of the grooves 33~40 are inserted in the grooves 33~40 and then fixed to the waveguide 21 by soldering 43~50 from outside of the waveguide 21. In this case, in addition to the soldering, fixing means such as metal welding may be suitably selected. The flanges 41, 42 are installed on both ends of the waveguide 21 and used for connection to other waveguides or the like.

FIG. 6 is a sectional view taken in line A—A of FIG. 5. In FIG. 6, numerals 51~53 designates a transmission path of characteristic impedance Z determined by dimensions in width and height of the waveguide 21. FIG. 7 and FIG. 8 show equivalent circuits of FIG. 6. FIG. 7 is an equivalent circuit in ideal state where thickness of each of the inductor plates 22, 23, 26, 27 is zero. In actual state, however, the thickness of each of the inductor plates 22, 23, 26, 27 does not become zero but an equivalent circuit shown in FIG. 8 applies. That is, as shown in the circuit constitution of FIG. 8, the thickness of each of the inductor plates 22, 23, 26, 27 is represented by coils 54~57 inserted in series to the transmission path, and the coils 54~57 act to lower the center frequency of the pass band of the waveguide filter. Consequently, the inductor plates 22~29 used in the waveguide filter must be made as thin as possible. Numerals 58, 59 designate equivalent elements of the inductor plates 22, 23, 26, 27.

FIG. 9 is a fragmentary sectional view of the grooves 33~40 for insertion of the inductor plates 22~29. Top end portions of the inductor plates 22, 26 or bottom portions of the grooves 33, 37 cannot be made rectangular accurately on account of the maching technology, but in usual the top end portions of the inductor plates 22, 26 are cut slantwise or the bottom portions of the grooves 33, 37 are rounded.

FIG. 10 is a sectional view taken in line B—B of FIG. 5, and illustrates state that the inductor plates 22, 26 are mounted on the waveguide 21. The inductor plates 22, 26 are too thin to be pushed strongly against the grooves 33, 37 of the waveguide 21, thereby gaps 60~62 are apt to be produced between the top end portions of the inductor plates 22, 26 and the bottom portions of the grooves 33, 37 of the waveguide 21.

FIG. 11 is a sectional view taken in line C—C of FIG. 5, and illustrates state that the inductor plates 22~29 are mounted on the waveguide 21 in similar manner to FIG. 10. Since width of the grooves 37, 38 is not coincident with thickness of the inductor plates 26, 27, gaps 63~65 are apt to be produced between the inductor plates 26, 27 and the waveguide 21.

FIG. 12 illustrates state that the inductor plate 22 is fixed to the waveguide 21 by means of soldering. In usual, solder may flow out at inside of the waveguide 21 so as to produce a convex portion 66 on inside surface of the waveguide 21, or otherwise solder does not flow smoothly and cannot attain to the inside surface of the waveguide 21 so as to produce a concave portion 67 on the inside surface of the waveguide 21.

As above described, the waveguide filter in the prior art is apt to produce the gap, the convex portion or the concave portion on account of the machining technology, and such defect affects the dimension error of the waveguide filter and the surface current path, resulting in deviation of the center frequency and the pass band width of the waveguide filter.

For example, the dimension error will be described. In a waveguide filter of three-stage connection where the center frequency is 12 GHz, the pass band width is 200 MHz, the waveguide is 19.05 mm in width and 9.25 mm in height, and longitudinal distance between the inductor plates is 16.3~17.0 mm, the error of 0.1 mm in the longitudinal distance between the inductor plates results in variation of the center frequency by about 50

MHz, and also the error of 0.1 mm in dimension of the inductor plate inside the waveguide and width of the induction window results in variation of the pass band width by about 12 MHz.

In another waveguide filter of three-stage connection where the center frequency is 50 GHZ, the pass band width is 200 MHz, the waveguide is 4.78 mm in width and 2.39 mm in height, and the longitudinal distance between the inductor plates is 3.6~3.7 mm, the error of 0.01 mm in the longitudinal distance between the inductor plates results in variation of the center frequency by about 90 MHz, and also the error of 0.01 mm in dimensions of the inductor plate inside the waveguide and width of the induction window results in variation of the pass band width by about 10 MHz.

Thus the waveguide filter in the prior art has disadvantages in that the small dimension error results in large variation in the center frequency and the pass band width.

These factors will be mentioned specifically. As shown in FIG. 9, the top end portion of the inductor plate is slanted on account of the machining technology. The bottom portion of the groove for insertion of the inductor plate is rounded also on account of the machining technology. Consequently, even when the inductor plate is inserted in the groove, the gap is produced between the waveguide and the inductor plate as shown in FIG. 10. The inductor plate is too thin to be pushed strongly during the assembling thereby the gap cannot be eliminated. The gap may cause variation in dimensions of the inductor plate inside the waveguide and width of the induction window and deviation of the pass band width from a prescribed value.

Since thickness of the inductor plate is not coincident with width of the groove, a gap as shown in FIG. 11 may be produced. The gap causes error in the longitudinal distance between the inductor plates and deviation of the center frequency. Further the gap deteriorates the return loss and the ripple characteristics of the pass band.

If the convex portion or the concave portion due to soldering is produced as shown in FIG. 12, the surface current path is lengthened by the convex portion or the concave portion and the center frequency deviates from the prescribed value. Since the junction surface between the waveguide and the inductor plate is not smooth on account of the convex portion or the concave portion due to soldering, high-frequency resistance in the junction surface increases and Q of the circuit decreases and the transmission loss in the pass band increases.

When the repair is performed at finding the dimension error or the defect in the inductor plate and the waveguide or for the part changing and the part correcting, since the fixing is performed by soldering and the waveguide has the integral structure, the repair work is very troublesome and the waveguide filter is not suitable for the mass production.

SUMMARY OF THE INVENTION

In order to eliminate above-mentioned disadvantages of the waveguide filter in the prior art, an object of the invention is to provide a waveguide filter wherein a plurality of waveguides are made in blocks, and inductor plates are grasped between these waveguides, thereby the dimension error of various parts of the waveguide filter is made quite small, deviation of the center frequency and the pass band width is little, the assembling work is efficient, and the repair becomes quite easy.

In order to attain the above object, a waveguide filter according to the invention comprises waveguides with length corresponding to the center frequency of a band pass filter, and shunt inductor plates each having sufficient size to cover an opening of the waveguide and an induction window smaller than the opening, wherein the opening is opposed to the induction window, and the waveguides and the shunt plates are arranged alternately in close contact state.

Since the waveguides with length corresponding to the center frequency and the inductor plates are arranged alternately in close contact state so that the opening of each waveguide is opposed to the induction window of each inductor plate, necessity of grroves and soldering is obviated although necessary in the prior art, the dimension error due to the grooves and producing of the convex portion or the concave portion due to the soldering can be eliminated, and the center frequency and the pass band width become prescribed values respectively, thus the waveguide filter can be obtained without necessitating the adjustment.

PREFERRED EMBODIMENT OF THE INVENTION

Figure 1:
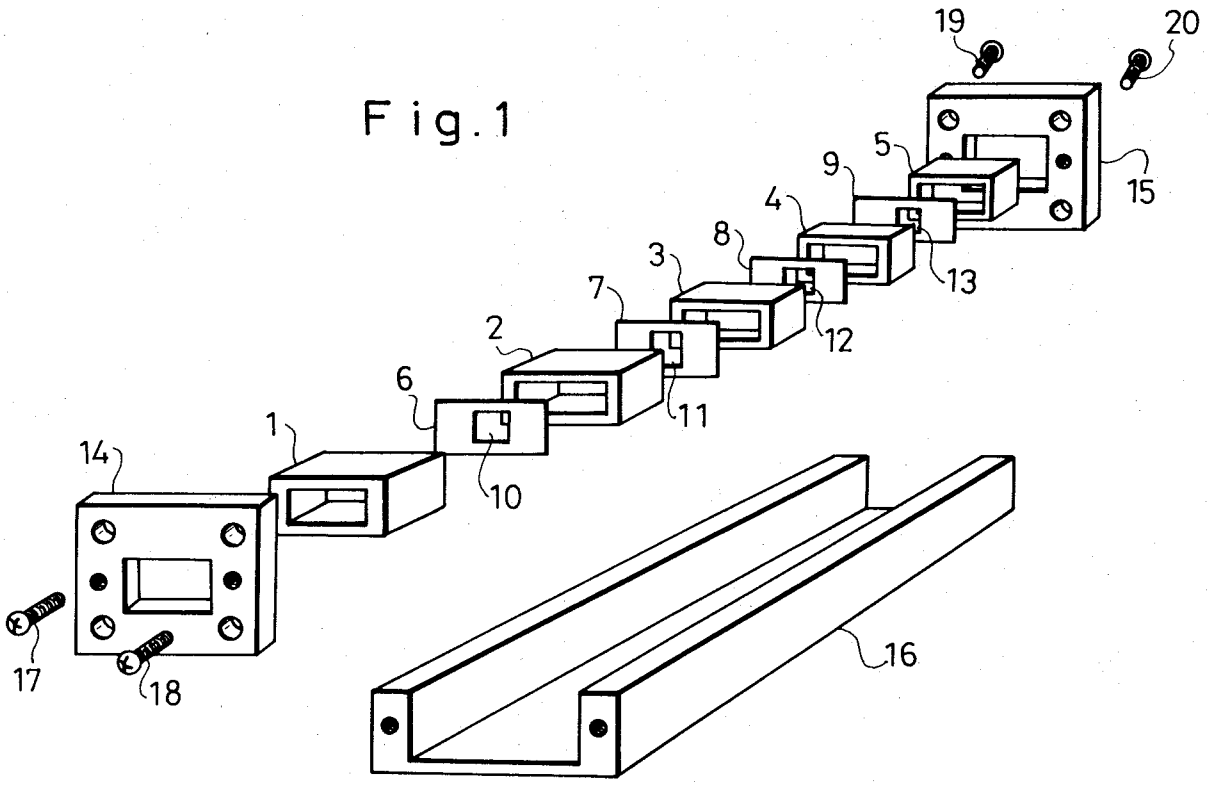
FIG. 1 is an exploded perspective view of a waveguide filter as an embodiment of the invention.

An embodiment of the invention will now be described in detail referring to FIG. 1 and FIG. 2. FIG. 1 is an exploded perspective view of a waveguide filter as an embodiment of the invention, and FIG. 2 is an assembled perspective view of FIG. 1.

Figure 2:
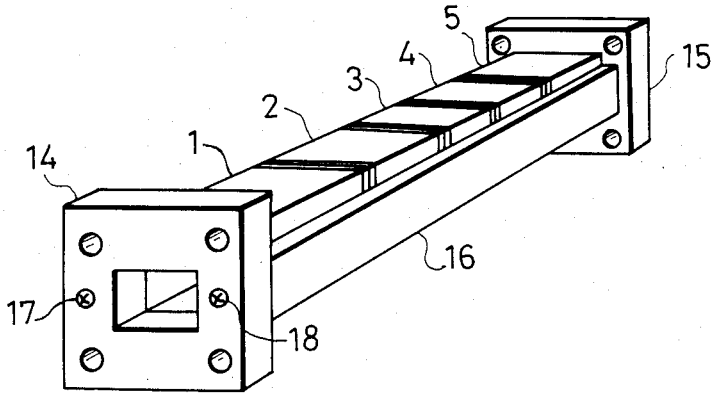
FIG. 2 is an assembled perspective view of the waveguide filter in FIG. 1.
Figure 3:
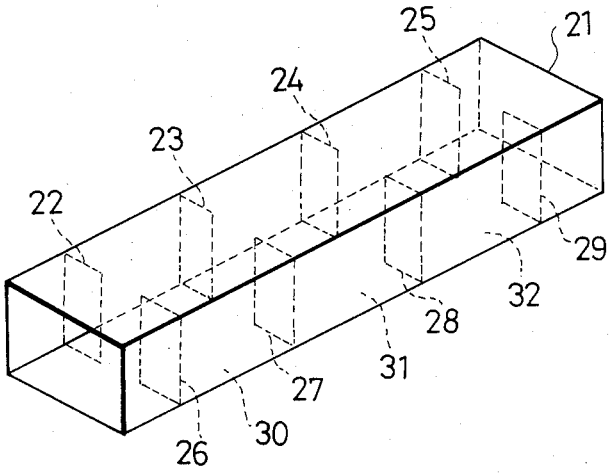
FIG. 3 is a perspective view of a waveguide filter illustrating basic structure.
Figure 4:
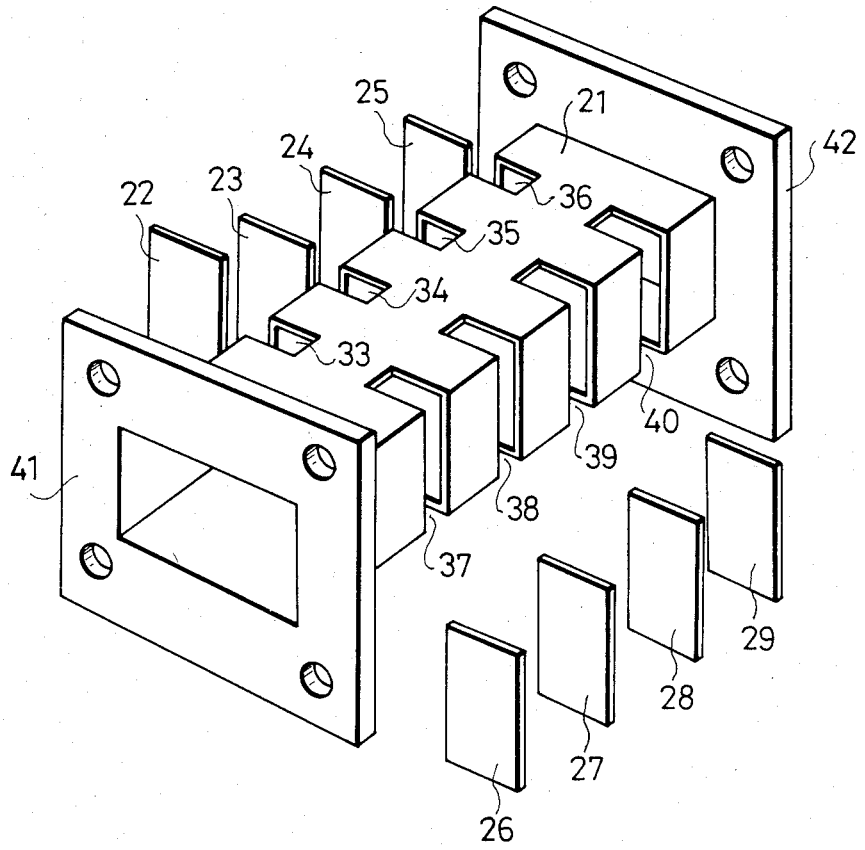
Fig. 4 PRIOR ART
FIG. 4 is an exploded perspective view of an example of a waveguide filter in the prior art.
Figure 5:
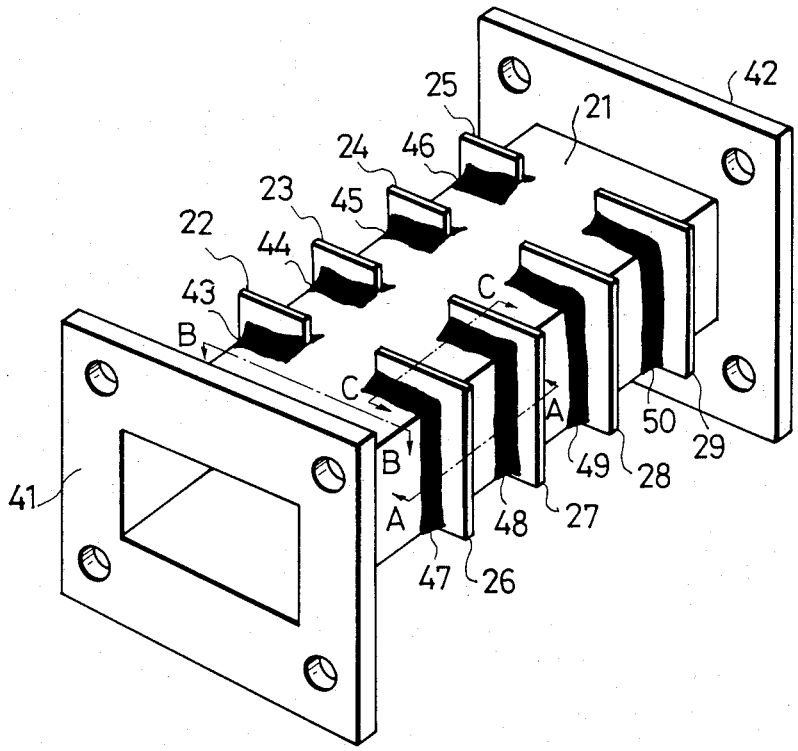
Fig. 5 PRIOR ART
FIG. 5 is an assembled perspective view of the waveguide filter in FIG. 4.
Figure 6:
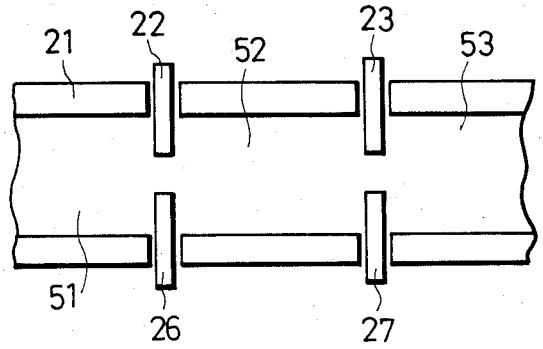
Fig. 6 PRIOR ART
FIG. 6 is a sectional view taken in line A—A of FIG. 5.
Figure 7:
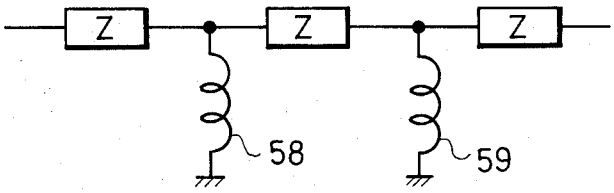
Fig. 7 PRIOR ART
FIGS. 7 and 8 are equivalent circuit diagrams of FIG. 6.
Figure 8:
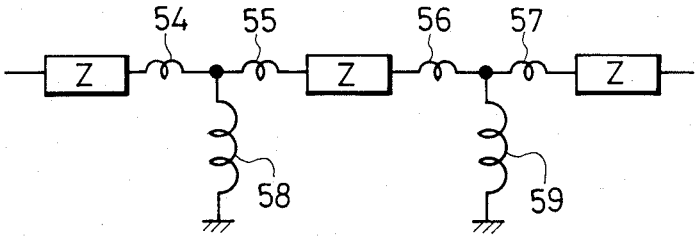
Fig. 8 PRIOR ART
Figure 9:
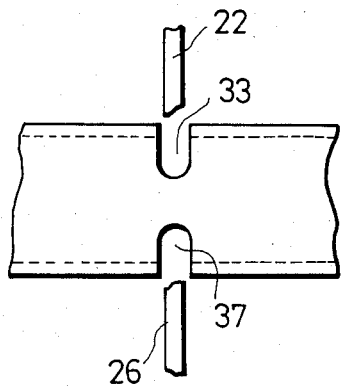
FIG. 9 is an enlarged sectional view of an inductor plate and a groove.
Figure 10:
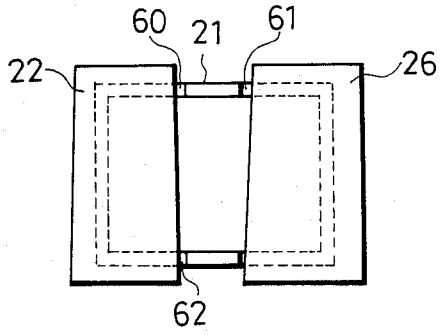
Fig. 10 PRIOR ART
FIG. 10 is a sectional view taken in line B—B of FIG. 5.
Figure 11:
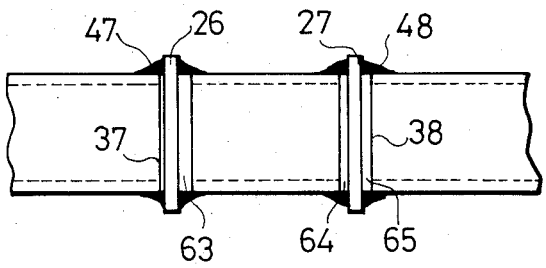
Fig.11 PRIOR ART
FIG. 11 is a sectional view taken in line C—C of FIG. 5.
Figure 12:
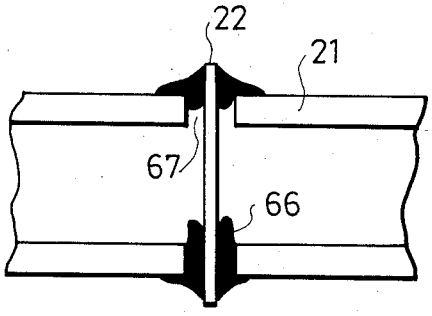
FIG. 12 is a sectional view illustrating soldering state when an inductor plate is installed by soldering.

In FIG. 1 and FIG. 2, numerals 1~5 designate waveguides, numerals 6~9 inductor plates with induction windows 10~13, numerals 14, 15 flanges, numeral 16 a support bed, and numerals 17~20 screws. The waveguides 2~4 are machined precisely in length, width and height corresponding to the center frequency of the band pass filter. The inductor plates 6~9 are provided with the induction windows 10~13 of square hole form each having width required as a band pass filter, and thickness of each inductor plate is made about 0.05 mm because the mechanical strength is not required. Since the waveguides 1, 5 have no relation to the frequency of the band pass filter, they may be set to any length. The waveguides 1, 5 are disposed on both ends, and the inductor plates 6~9 and the waveguides 1~5 are arranged alternately in the order of the waveguide 1, the inductor plate 6, the waveguide 2, the inductor plate 7 and so on, and held on the support bed 16. The support bed 16 is set to length slightly less than the arrangement length of the waveguides 1~5 and the inductor plates 6~9, and the flanges 14, 15 are attached to the support bed 16 from both ends and then the waveguides 1~5 and the inductor plates 6~9 are connected in close contact state by tightening with the screws 17~20.

Although the waveguides and the inductor plates are connected in close contact state using the screws in the above embodiment, they may be grasped by members with spring property. When the size of the induction window of the inductor plate is made less than height of the waveguide, the size of the induction window does not vary even if the inductor plate is shifted in the vertical direction. Then, since the magnetic field is distributed uniformly, amount of the coupled magnetic field becomes constant and any problem does not occur to the shifting of the inductor plate in the vertical direction. Also since width of the induction window is less than that of the inductor plate, the size of the induction window does not vary to the shifting of the inductor plate in the width direction. Thus although the size of the inductor plate in the lateral direction varies, various characteristics scarecely vary.

In the waveguide filter of the invention as above described, since the inductor plate need not be inserted in a groove and pushed against bottom portion of the groove, the mechanical strength is not required and therefore the induction plate may be made quite thin and the error in length of the waveguide between the inductor plates can be made quite small value, thereby the center frequency deviates scarcely from the prescribed value. For example, when thickness of the inductor plate is made 0.05 mm, the thickness of the inductor plate scarcely affects the center frequency 50 MHz. Since the induction window of the inductor plate is constituted by punching a square hole on the induction plate, it can be formed in accurate dimensions and the pass band width scarcely varies. Since the waveguides and the inductor plates are assembled by tightening from both ends of the waveguide filter using the screws, a gap due to the groove is not produced as in the prior art and the center frequency does not deviate thereby the waveguide filter can be constituted without necessitating the adjustment. Since soldering is not used to install the inductor plate, the convex portion or the concave portion due to the soldering is not produced thereby the surface current path does not vary and the center frequency does not deviate and there is no transmission loss in the pass band. Since there is no fixed portion due to the soldering, the parts can be easily changed or repaired thus the waveguide filter has quite excellent effects.

What is claimed is:

1. A waveguide filter comprising:

a plurality of waveguide sections each formed as a hollow body with a front and rear opening therethrough and having a length corresponding to a selected center frequency of a band pass filter;

a plurality of shunt inductor plates each having a sufficient size to cover the opening of an associated waveguide section and formed with an induction window therein having a size smaller than the waveguide section opening:

a support bed extending longitudinally between opposite ends thereof and formed with longitudinal bottom and side walls forming a concave channel for holding the waveguide sections and shunt inductor plates, alternately arranged with a shunt inductor plate interposed between adjacent waveguide sections, in said concave section; and securing means and tightening means on said opposite end of said support bed for securing said alternately arranged waveguide sections and shunt inductor plates tightly in close contact with each other in said concave section of said support bed, wherein said securing means comprises said support bed having a longitudinal length slightly less than a total length of said alternately arranged waveguide sections and shunt inductor plates and a pair of end flanges each secured on a respective end of said support bed by said tightening means for holding said waveguide sections and inductor plates therebetween.

2. A waveguide filter according to claim 1, wherein said tightening means are a pair of screws threaded through holes in each flange plate into threaded holes in a respective end of said support bed.

* * * * *